US005904837A

United States Patent [19]

Fujiyama

[11] Patent Number: 5,904,837

[45] Date of Patent: May 18, 1999

[54] PROCESS FOR FLUID CATALYTIC CRACKING OF OILS

[75] Inventor: Yuichiro Fujiyama, Yokohama, Japan

[73] Assignees: Nippon Oil Co., Ltd.; Petroleum Energy Center, both of Tokyo, Japan

[21] Appl. No.: 08/944,195

[22] Filed: Oct. 3, 1997

[30] Foreign Application Priority Data

Oct. 7, 1996 [JP] Japan ..... 8-282927

[51] Int. Cl.[6] ..... C10G 11/00

[52] U.S. Cl. ..... 208/164; 208/113; 208/156; 208/74; 208/159; 208/160

[58] Field of Search ..... 208/164, 160, 208/156, 113, 74, 159

[56] References Cited

U.S. PATENT DOCUMENTS

| | | | |
|---|---|---|---|
| 3,074,878 | 1/1963 | Pappas | 208/127 |
| 4,419,221 | 12/1983 | Castagnos, Jr. et al. | 208/113 |
| 4,859,313 | 8/1989 | Lengemann et al. | 208/156 |
| 4,980,053 | 12/1990 | Li et al. | 208/120 |
| 5,326,465 | 7/1994 | Yongqing et al. | 208/120 |
| 5,462,652 | 10/1995 | Wegerer | 208/113 |

*Primary Examiner*—Helane Myers
*Attorney, Agent, or Firm*—Kubovcik & Kubovcik

[57] ABSTRACT

A process for the fluid catalytic cracking of oils, wherein an oil is brought into contact with catalyst particles using a fluid catalytic cracking reactor under the following conditions: a) a reaction zone outlet temperature of 580 to 630° C., catalyst/oil ratio of 15 to 50 wt./wt., contact time of 0.1 to 3.0 sec.; b) a catalyst-concentrated phase temperature in the regenerating zone of 670 to 800° C.; and c) a temperature of regenerated catalyst to be forwarded into the reaction zone of 610 to 665° C.; thereby producing light fraction olefins. The process increases the cracking rate of heavy fractions of oils while producing a lessened amount of dry gases generated by the overcracking of light fractions to obtain light fraction olefins in a high yield.

10 Claims, No Drawings

PROCESS FOR FLUID CATALYTIC CRACKING OF OILS

BACKGROUND OF THE INVENTION

1. Technical Field

This invention relates to a process for catalytic cracking of an oil, particularly to a fluid catalytic cracking (FCC) process which comprises cracking a heavy fraction oil to obtain olefins which are light fraction oils such as ethylene, propylene, butene and pentene.

2. Description of the Prior Art

In a usual catalytic cracking technique, petroleum-derived hydrocarbons are catalytically cracked with a catalyst thereby to obtain gasoline as the main product, a small amount of LPG, a cracked gas oil and the like, and coke deposited on the catalyst is then burnt away with air to recycle the regenerated catalyst for reuse.

In recent years, however, there has been a tendency that a fluid catalytic cracking apparatus is utilized not as an apparatus for producing gasoline but as an apparatus for producing light fraction olefins for use as petrochemical materials. Such utilization of an original fluid catalytic cracking apparatus as an olefin producing apparatus is economically advantageous particularly to an oil refinery in which a petroleum refining factory and a petrochemical factory are highly closely combined.

On the other hand, much attention has been paid to environmental problems, and therefore regulation of the contents of olefins and aromatics in gasoline for automobiles, obligation to add oxygen-containing materials (MTBE or the like), or the like has started to be enforced. In consequence, it can be anticipated that alkylates and MTBE will be increasingly demanded as base materials for high-octane gasoline in place of FCC gasoline and catalytically reformed gasoline. Therefore, it will be necessary to increase the production of propylene and butene which are raw materials for these base materials.

Methods for producing the light fraction olefins by the fluid catalytic cracking of a heavy fraction oil include methods which comprise contacting a raw oil with a catalyst for a shortened time (U.S. Pat. Nos. 4,419,221, 3,074,878 and 5,462,652, and European Patent No. 315,179A), a method which comprises carrying out a cracking reaction at a high temperature (U.S. Pat. No. 4,980,053), and methods which comprise using pentasil type zeolites (U.S. Pat. No. 5,326,465 and Japanese Patent National Publication (Kohyo) No. Hei 7-506389 (506389/95)).

Even these known methods still cannot sufficiently produce light fraction olefins selectively. For example, the high-temperature cracking reaction will result in concurrence of thermal cracking of a heavy fraction oil thereby increasing the yield of dry gases from said oil; the shortened-time contact of a raw oil with a catalyst will be able to decrease a ratio of conversion from light fraction olefins to light fraction paraffins due to its inhibition of a hydrogen transfer reaction, but it will be unable to increase a ratio of conversion of heavy fraction oils to light fraction oils; and, likewise, the use of pentasil type zeolites will only enhance the yield of light fraction oils by excessively cracking the gasoline once produced.

SUMMARY OF THE INVENTION

An object of this invention is to provide a process for the fluid catalytic cracking of oils, which is capable of increasing the cracking rate of heavy fractions of oils while producing a lessened amount of dry gases such as hydrogen gas, methane gas and ethane gas generated by the overcracking of light fractions to obtain light fraction olefins such as ethylene, propylene, butene and pentene in a high yield. After intensive investigations, the present inventor has found that the above-described object can be attained by employing specified temperature, catalyst/oil ratio, reaction zone type and contact time and also by controlling the temperature of a regenerated catalyst before it is introduced into the reaction zone. This invention has been completed on the basis of this finding.

More particularly, this invention is directed to the provision of a process for the fluid catalytic cracking of oils, which comprises bringing an oil into contact with catalyst particles by using a fluid catalytic cracking reactor comprising a catalyst-regenerating zone, downflow-type reaction zone, separation zone and catalyst stripping zone under the following conditions:

a) a reaction zone outlet temperature being 580 to 630° C., catalyst/oil ratio being 15 to 50 wt./wt., contact time being 0.1 to 3.0 sec.;

b) a catalyst-concentrated phase temperature in the regenerating zone being 670 to 800° C.; and c) a temperature of regenerated catalyst to be forwarded into the reaction zone being 610 to 665° C., thereby producing light fraction olefins.

DESCRIPTION OF THE PREFERRED EMBODIMENTS

This invention will be described below in more detail.

Raw Oil (Feedstock or Charge Stock)

In the fluid catalytic cracking of this invention, a heavy fraction oil is used mainly as a raw oil. The heavy fraction oils used herein include a straight-run gas oil, a vacuum gas oil (VGO), an atmospheric-pressure distillation residue, a reduced-pressure distillation residue, a cracked gas oil, and heavy fraction oils obtained by hydrorefining said residues and gas oils. These heavy fraction oils may be used singly or jointly or as a mixture thereof with a minor portion of a light fraction oil.

Apparatus and Process

The fluid catalytic cracking apparatus which can be used in this invention comprises a regenerating zone (a regenerating tower), a downflow-type reaction zone (a reactor), a separation zone (a separator) and a catalyst-stripping zone.

The term "fluid catalytic cracking" referred to herein indicates that the above-described heavy fraction oil as the raw oil is continuously brought into contact with a catalyst kept in a fluidizing state under specific operating conditions to crack the heavy fraction oil thereby producing light fraction hydrocarbons mainly comprising light fraction olefins. The reaction zone used in an ordinary fluid catalytic cracking is a so-called riser reaction zone wherein both catalyst particles and raw oil ascend through a pipe. On the other hand, it is one of the characteristic features of this invention to employ a downflow type reaction zone wherein both catalyst particles and raw oil descend through a pipe so as to avoid the back mixing because the catalyst/oil ratio of this invention is far higher than that of an ordinary fluid catalytic cracking process.

A mixture of products obtained by the catalytic cracking of the heavy fraction oil in contact with the catalyst kept in fluidizing state in the downflow type reaction zone, unreacted materials and catalyst is then forwarded into the separation zone.

When the reaction zone outlet temperature is as very high as 580 to 630° C., the cracking reaction continues even after the mixture of the products, unreacted materials and catalyst has been withdrawn from the reaction zone to cause a phenomenon called "overcracking" wherein the light fraction olefins which are preferred products are further cracked to increase the dry gases. In this invention, therefore, it is desirable to forward the mixture of the products, unreacted materials and catalyst into a high-speed separation zone before the catalyst is precisely removed from the mixture of the products, unreacted materials and catalyst in a cyclone separation zone. The term "high-speed separation zone" referred to herein indicates the zone in which the residence time of gases is short and the residence time distribution is in a narrow range, while the separation efficiency is low. In the high-speed separation zone, the residence time distribution of the gases is characteristically as narrow as only 0.1 to 0.3 second, preferably 0.1 to 0.2 second, while a part of the gases stays in the cyclone separation zone for a long time and the residence time distribution of the gases in the cyclone separation zone is as wide as 0.1 to 1.0 second. In this invention, at least 90%, preferably at least 95%, of the catalyst is removed from the mixture of the products, unreacted materials and catalyst in the high-speed separation zone. Examples of the high-speed separation zones are a box-type and a U-bent type.

In this invention, the overcracking is desirably inhibited by mixing the mixture of the products, unreacted materials and catalyst with a quenching oil or quenching gas upstream of or downstream of the high-speed separation zone to quench the mixture of the product, unreacted materials and catalyst. The mixture of the products, unreacted materials and catalyst is finally forwarded into the cyclone separation zone having one or more stages to remove the residual catalyst still remaining in the mixture after the removal in the high-speed separation zone. The product taken out of the cyclone separation zone is recovered. The unreacted materials may be fed into the reaction zone again. On the other hand, the catalyst separated from the mixture in the cyclone separation zone or in both the high-speed separation zone and cyclone separation zone is forwarded into a catalyst-stripping zone to remove the most part of hydrocarbons such as the products and unreacted materials from the catalyst (catalyst particles). The catalyst on which carbonaceous materials and partially heavy fraction hydrocarbons are deposited is further forwarded from said catalyst-stripping zone into a regenerating zone. In the regenerating zone, the catalyst on which the carbonaceous materials and partially heavy fraction hydrocarbons are deposited is subjected to oxidation treatment to mostly remove the carbonaceous materials and the hydrocarbons each deposited on the catalyst thereby obtaining a regenerated catalyst. The oxidation treatment includes combustion. The regenerated catalyst is cooled and then continuously recycled to the reaction zone.

The "reaction zone outlet temperature" referred to in this invention means an outlet temperature of a downflow type reactor with a fluidized bed (downflow-type reaction zone), and it is a temperature before separation of the cracked products from the catalyst, or a temperature before quenching thereof. In this invention, the reaction zone outlet temperature can be in a range of 580 to 630° C., preferably 600 to 620° C. If the reaction zone outlet temperature is lower than 580° C. then the light fraction olefins will be unable to be obtained in a high yield, while if it is higher than 630° C. then the thermal cracking of the heavy fraction oil fed will be noticeable thereby undesirably increasing the amount of dry gases generated.

The term "catalyst/oil ratio" referred to herein indicates a ratio of the amount (ton/h) of the catalyst recycled to a rate of the raw oil fed (ton/h). In this invention, the catalyst/oil ratio can be 15–50 wt/wt, preferably 20–40 wt/wt. In this invention, since the catalytic cracking reaction is conducted in a short contact time, if a catalyst/oil ratio is less than 15, the incomplete catalytic cracking reaction undesirably occurs. On the other hand, if the catalyst/oil ratio exceeds 50, the amount of the catalyst recycled is undesirably large thereby to lower a temperature of the regenerating zone whereby the combustion of the carbonaceous materials occurs incompletely, or whereby a catalyst residence time necessary for the regeneration of the used catalyst becomes excessively long unfavorably.

The term "contact time" referred to herein indicates either a time between the start of contact of the raw oil with the catalyst and the separation of the produced cracked products from the catalyst in the separation zone, or a time between the start of contact of the raw oil with the catalyst and the quenching in case that the obtained cracked products are quenched just upstream of the separation zone. The contact time in this invention may be selected from the range of 0.1 to 3.0 sec., preferably 0.1 to 2.0 sec., more preferably 0.1 to 1.5 sec., most preferably 0.1 to 1.0 sec. When the contact time is less than 0.1 sec., the raw oils are unfavorably withdrawn from the reaction zone before the cracking reaction has proceeded completely. When the contact time exceeds 3.0 sec., the rate of the conversion of the light fraction olefins into light fraction paraffins is undesirably increased by the hydrogen transfer reaction which occurs successively after the cracking reaction.

The "catalyst-concentrated phase temperature in the regenerating zone" (hereinafter referred to as "regenerating zone temperature") referred to herein indicates a temperature measured just before the catalyst particles fluidized in a concentrated state in the regenerating zone is withdrawn from said zone. In this invention, the regenerating zone temperature can be 670 to 800° C., preferably 700 to 740° C. When the regenerating zone temperature is less than 670° C., the combustion of the carbonaceous materials deposited on the catalyst is slow and said carbonaceous materials can not be completely removed thereby to make the keeping of the catalytic activity impossible, or the catalyst residence time in the regenerating zone must be prolonged to a very long time for the complete removal of the carbonaceous materials thereby unfavorably necessitating a very large regenerating zone uneconomically. On the other hand, when the regenerating zone temperature is more than 800° C., the quantity of heat brought into the reaction zone from the regenerating zone by the catalyst is too large to keep the desirable temperature in the reaction zone or, in such a case, there is undesirably required an excess capacity of a catalyst cooler necessary for cooling the regenerated catalyst particles to a predetermined temperature so as to keep a desirable temperature in the reaction zone uneconomically.

In this invention, the catalyst particles regenerated in the regenerating zone are cooled to 610 to 665° C., preferably 620 to 640° C., before the particles are forwarded into the reaction zone so as to keep the heat balance in the reaction zone. When a temperature of the regenerated catalyst is more than 665° C. or less than 610° C., the reaction zone temperature can not undesirably be kept at a predetermined temperature. The method of cooling the regenerated catalyst is not particularly limited. For example, a heat exchanger (catalyst cooler) in which air, steam or the like is used as a heat-exchanging medium is used.

Examples of the quenching oils are petroleum distillates obtained under atmospheric or reduced pressure such as kerosene, straight-run gas oil and vacuum gas oil; petroleum distillation residues obtained under atmospheric or reduced pressure; oils obtained by the hydrogenation of the petroleum distillates or petroleum distillation residues; oils obtained by the thermal cracking of the petroleum distillates or petroleum distillation residues; oils obtained by the catalytic cracking of the petroleum distillates or petroleum distillation residues; and mixtures of them.

The quenching oils are preferably hydrocarbons which can be in the form of liquid at a temperature and under a pressure employed when the quenching oils are introduced into the mixture of the products, unreacted materials and catalyst.

Examples of the quenching gases are steam, paraffinic hydrocarbons having 1 to 6 carbon atoms such as methane, ethane, propane, butane, pentane and hexane and mixtures of them. The quenching gases are preferably substances which can be in the form of gas at a temperature and under a pressure employed when the quenching gases are introduced into the mixture of the products, unreacted materials and catalyst.

As described above, the mixture of the cracked products, unreacted materials and catalyst can be quenched to 450 to 550° C., preferably 470 to 510° C., with the above-described quenching oils or quenching gases before said mixture is forwarded into the high-speed separation zone (upstream) or after said mixture is withdrawn from said zone (downstream). When said mixture is quenched to below 450° C., an excess amount of the quenching oils or quenching gases used is undesirably required and the reheating is undesirably necessary when the cracked products are distilled uneconomically. When said mixture is quenched to above 550° C., the overcracking and hydrogen transfer reaction can not unfavorably be controlled.

In this invention, although operating conditions of the fluid catalytic cracking reaction apparatus, except those described above, are not particularly restricted, the apparatus can be operated preferably at a reaction pressure of 1 to 3 $kg/cm^2G$.

The catalyst used in this invention is not particularly limited. Catalyst particles generally used for the fluid catalytic cracking reaction of a petroleum are usable herein. Particularly, there is preferably used a catalyst comprising ultrastable Y-type zeolite as an active component and a matrix which is substrate material for the zeolite. Examples of the matrixes are clays such as kaolin, montmorillonite, halloysite and bentonite, and inorganic porous oxides such as alumina, silica, boria, chromia, magnesia, zirconia, titania and silica-alumina, and the mixture thereof. The content of the ultrastable Y-type zeolite in the catalyst used in this invention can be in a range of 2 to 60 wt %, preferably 15 to 45 wt %.

In addition to the ultrastable Y-type zeolite, there can be used a catalyst comprising a crystalline aluminosilicate zeolite or silicoaluminophosphate (SAPO) each having smaller pores than the ultrastable Y-type zeolite. The aluminosilicate zeolites and the SAPOs include ZSM-5, SAPO-5, SAPO-11 and SAPO-34. The zeolite or the SAPO may be contained in the catalyst particles containing the ultrastable Y-type zeolite, or may be contained in other catalyst particles.

The catalyst used in this invention preferably has a bulk density of 0.5 to 1.0 g/ml, an average particle diameter of 50 to 90 $\mu$m, a surface area of 50 to 350 $m^2/g$ and a pore volume of 0.05 to 0.5 ml/g.

The catalyst used in this invention can be manufactured by a usual manufacturing method. For example, a dilute water glass solution ($SiO_2$ concentration=8 to 13%) is added dropwise to sulfuric acid to obtain a silica sol having a pH value of 2.0 to 4.0. Thereafter, the ultrastable Y-type zeolite and kaolin are added to the whole of this silica sol and they are then kneaded to form a mixture which is then spray dried in hot air of 200 to 300° C. Afterward, the thus obtained spray dried product is washed with 0.2% ammonium sulfate at 50° C., dried in an oven at 80 to 150° C. and then fired at 400 to 700° C. to obtain a catalyst usable in this invention.

EXAMPLES

Next, this invention will be described with reference to the following examples and the like, but this invention should not be limited to these examples.

Example 1

The catalytic cracking of desulfurized VGO produced in the Middle East was conducted with an insulating type FCC pilot apparatus (made by Xytel Company) having a downflow-type reaction zone as the fluid catalytic cracking reaction apparatus.

21,550 g of a dilute solution ($SiO_2$ concentration=11.6%) of JIS No. 3 water glass were added dropwise to 3,370 g of 40% sulfuric acid to obtain a silica sol of pH value 3.0. The whole of the silica sol so obtained was incorporated with 3,000 g of an ultrastable Y-type zeolite (made by Toso Co., Ltd., HSZ-370HUA) and 4,000 g of kaolin, after which the resulting mixture was kneaded and then spray dried in hot air of 250° C. Afterward, the thus obtained spray dried product was washed with 50 liters of 0.2% ammonium sulfate at 50° C., dried in an oven at 110° C. and then fired at 600° C. to obtain a catalyst. In this case, the content of the zeolite in the catalyst was 30 wt %. Prior to feeding the catalyst into the apparatus, the catalyst was subjected to steaming at 800° C. for 6 hours with 100% steam in order to bring the catalyst into a pseudo-equilibrium state.

The scale of the apparatus was as follows:

The inventory (amount of the catalyst) was 2 kg, the raw oil feed was 1 kg/h and the reaction pressure was 2 $kg/cm^2G$. The operation conditions were as follows:

The catalyst/oil ratio was 40, the reaction zone outlet temperature was 600° C. and the contact time was 0.5 sec.

A mixture of products, unreacted materials and catalyst was withdrawn from a reaction zone, and then forwarded to a cyclone separation zone. In the cyclone separation zone, the catalyst was removed from the mixture. Then, the catalyst was combusted (oxidation treatment) in the regenerating zone. In this stage, the regenerating zone temperature was 680° C. To keep the reaction zone outlet temperature at 600° C., the regenerated catalyst taken out of the regenerating zone was air-cooled by air to 655° C. and then recycled into the reaction zone. The coke on the regenerated catalyst had been completely removed. The yields of the cracked products thus obtained are given in Table 1.

Example 2

The catalytic cracking of desulfurized VGO produced in the Middle East was conducted with an insulating type FCC pilot apparatus (made by Xytel Company) having a downflow-type reaction zone as the fluid catalytic cracking reaction apparatus. The catalyst is the same as in Example 1.

The scale of the apparatus was as follows: The inventory (amount of the catalyst) was 2 kg, the raw oil feed was 1 kg/h and the reaction pressure was 2 $kg/cm^2G$. The operation conditions were as follows:

The catalyst/oil ratio was 40, the reaction zone outlet temperature was 600° C. and the contact time was 1.5 sec.

A mixture of products, unreacted materials and catalyst was withdrawn from a reaction zone, and then forwarded to a high-speed separation zone and a cyclone separation zone. In both the high-speed separation zone and cyclone separation zone, the catalyst was removed from the mixture. Then, the catalyst was combusted (oxidation treatment) in the regenerating zone. In this stage, the regenerating zone temperature was 680° C. To keep the reaction zone outlet temperature at 600° C., the regenerated catalyst taken out of the regenerating zone was air-cooled by air to 655° C. and then recycled into the reaction zone. The coke on the regenerated catalyst had been completely removed. The yields of the cracked products thus obtained are given in Table 1.

Comparative Example 1

The cracking was conducted by using the same scale of the apparatus, catalyst and raw oil as in Example 1. The catalyst/oil ratio was 10 and the contact time was 0.5 sec. Since the catalyst/oil ratio was low, the difference between the reaction zone outlet temperature and the regenerating zone temperature became large. When the reaction zone outlet temperature was 600° C., the regenerating zone temperature at which the catalyst was subjected to combustion was 765° C. The regenerated catalyst (765° C.) taken out of the regenerating zone was recycled into the reaction zone without cooling. Since the catalyst/oil ratio is low, the reaction zone outlet temperature could be kept at 600° C. even without cooling the catalyst. The yields of the cracked products thus obtained are given in Table 1.

Comparative Example 2

The cracking was conducted by using the same scale of the apparatus, catalyst and raw oil as in Example 1. The catalyst/oil ratio was 40 and the contact time was 0.5 sec. The regenerating zone temperature was 680° C. which was sufficient for the coke combustion. When the heat balance was kept by recycling the regenerated catalyst (680° C.) into the reaction zone without cooling, the reaction zone outlet temperature was 635° C. The yields of the cracked products thus obtained are given in Table 1.

Comparative Example 3

The catalytic cracking was conducted in the same manner as in Example 1 except that the contact time was altered to 4.0 sec. Since light fraction paraffins, dry gases and coke were increased in amount by the overcracking reaction and hydrogen transfer reaction successively occurring after the cracking reaction, the light fraction olefins could not be obtained in a high yield.

Comparative Example 4

The cracking was conducted by using the same scale of the apparatus, catalyst and raw oil as in Example 1. The catalyst/oil ratio was 40 and the contact time was 0.5 sec. When the heat balance was kept by controlling the reaction zone outlet temperature at 600° C. and recycling the regenerated catalyst (641° C.) into the reaction zone without cooling, the regenerating zone temperature was 641° C. Since the cracking activity was rapidly lowered when the operation was continued under these conditions, the operation of the apparatus was stopped. The amount of the coke deposit on the regenerated catalyst was determined to find that it was 0.2% by weight based on the regenerated catalyst. This fact showed that the coke combustion in the regenerating zone was insufficient.

Comparative Example 5

The cracking was conducted under the same conditions as in Example 1 except that the riser type reaction zone was used. However, the stable operation was impossible, since the pressure change became serious upstream of and downstream of the riser type reaction zone.

TABLE 1

| | Ex. 1 | Ex. 2 | Comp. Ex. 1 | Comp. Ex. 2 |
|---|---|---|---|---|
| Reaction zone type | downflow | downflow | downflow | downflow |
| Reaction zone outlet temp. (°C.) | 600 | 600 | 600 | 635 |
| Regenerating zone temp. (°C.) | 680 | 680 | 765 | 680 |
| Catalyst/oil ratio (wt/wt) | 40 | 40 | 10 | 40 |
| Contact time (s) | 0.5 | 1.5 | 0.5 | 0.5 |
| Conversion rate (wt %) | 90.0 | 90.3 | 78.2 | 90.4 |
| Yields (wt %) | | | | |
| dry gases ($H_2$, $C_1$, $C_2$) | 4.5 | 4.7 | 6.8 | 6.9 |
| ethylene | 1.8 | 2.0 | 2.1 | 2.3 |
| propylene | 15.6 | 16.0 | 8.8 | 12.9 |
| butene | 17.5 | 17.1 | 11.2 | 15.1 |
| propane butane | 3.8 | 4.0 | 3.2 | 4.2 |
| gasoline | 38.7 | 38.2 | 39.8 | 39.8 |
| Light Cycle Oil (LCO) | 6.8 | 6.6 | 12.8 | 6.6 |
| Heavy Cycle Oil (HCO) | 3.2 | 3.1 | 9.0 | 30 |
| coke | 8.1 | 8.3 | 6.3 | 9.2 |

In the table 1, $C_1$represents methane gas and $C_2$represents ethane gas, and the conversion rate indicates that of the raw oil into the cracked products. When the catalyst/oil ratio and contact time are thus not within the ranges according to this invention, the catalytic activity was insufficient and, in addition, the contribution of the thermal cracking reaction competing with the catalytic cracking reaction becomes relatively high, and the yield of the dry gases is increased while decreasing the yield of the light fraction olefins. Further, the yield of the light fraction olefins is reduced by the overcracking reaction and hydrogen transfer reaction (Comparative Examples 1 and 3).

When the regenerating zone temperature is elevated to a temperature sufficient for the coke combustion without using the catalyst cooler, the reaction zone outlet temperature becomes excessively high, on the contrary, when the reaction zone outlet temperature is controlled within the range of this invention without the catalyst cooler, the regenerating zone temperature is not elevated to a point sufficient for the coke combustion and, therefore, the yields of the coke and dry gases are increased while decreasing the yield of the light fraction olefins, or the regeneration of the catalyst is insufficient thereby conducting unstable operation (Comparative Examples 2 and 4).

When the reaction zone type is not the downflow type, the fluid catalytic cracking reaction apparatus can not be operated stably even when the catalyst/oil ratio, the reaction zone outlet temperature, the regenerating zone temperature, contact time and regenerated catalyst temperature are within the ranges of this invention (Comparative Example 5).

As described above, the cracking rate of the heavy fractions of the raw oil can be increased, and the amount of the dry gases by the overcracking of the light fractions can be lessened while light fraction olefins such as ethylene, propylene, butene and pentene can be obtained in a high yield by employing the catalyst/oil ratio, the reaction zone outlet temperature, the regenerating zone temperature, the contact time and regenerated catalyst temperature each in the ranges of this invention in combination with the downflow reactor.

What is claimed is:

1. A process for the fluid catalytic cracking of oils, which comprises bringing an oil into contact with catalyst particles by using a fluid catalytic cracking reactor comprising a catalyst-regenerating zone, downflow-type reaction zone, separation zone and catalyst stripping zone under the following conditions:

a) a reaction zone outlet temperature being 580 to 630° C., catalyst/oil ratio being 15 to 50 wt./wt., contact time being 0.1 to 3.0 sec.;

b) a catalyst-concentrated phase temperature in the regenerating zone being 670 to 800° C.; and c) a temperature of regenerated catalyst to be forwarded into the reaction zone being 610 to 665° C., thereby producing light fraction olefins.

2. A process for the fluid catalytic cracking of oils according to claim 1, wherein the reaction zone outlet temperature is 600 to 620° C.

3. A process for the fluid catalytic cracking of oils according to claim 1, wherein the catalyst/oil ratio is 20 to 40 wt./wt.

4. A process for the fluid catalytic cracking of oils according to claim 1, wherein the contact time is 0.1 to 2.0 sec.

5. A process for the fluid catalytic cracking of oils according to claim 1, wherein the catalyst-concentrated phase temperature is 700 to 740° C.

6. A process for the fluid catalytic cracking of oils according to claim 1, wherein the temperature of regenerated catalyst to be forwarded into the reaction zone is 620 to 640° C.

7. A process for the fluid catalytic cracking of oils according to claim 1, wherein the separation zone comprises a cyclone separation zone and a high-speed separation zone, and a mixture of products obtained by the catalytic cracking in the reaction zone, unreacted materials and catalyst is forwarded into the high-speed separation zone before the cyclone separation zone.

8. A process for the fluid catalytic cracking of oils according to claim 7, wherein the mixture of the products, unreacted materials and catalyst is quenched by mixing the mixture with quenching oils or quenching gases upstream of or downstream of the high-speed separation zone.

9. A process for the fluid catalytic cracking of oils according to claim 1, wherein the catalyst comprise ultrastable Y-type zeolite and at least one matrix selected from the group consisting of kaolin, montmorillonite, halloysite, bentonite, alumina, silica, boria, chromia, magnesia, zirconia, titania and silica-alumina.

10. A process for the fluid catalytic cracking of oils according to claim 9, wherein content of the ultrastable Y-type zeolite in the catalyst is 2 to 60 wt %.

* * * * *